US007252921B2

(12) United States Patent
Thompson

(10) Patent No.: US 7,252,921 B2
(45) Date of Patent: Aug. 7, 2007

(54) TONERS WITH IMPROVED PIGMENT DISPERSION

(75) Inventor: Richard J. Thompson, Ohiopyle, PA (US)

(73) Assignee: International Communications Materials, Inc., Connellsvill, PA (US)

( * ) Notice: Subject to any disclaimer, the term of this patent is extended or adjusted under 35 U.S.C. 154(b) by 371 days.

(21) Appl. No.: 10/878,860

(22) Filed: Jun. 28, 2004

(65) Prior Publication Data

US 2005/0287462 A1 Dec. 29, 2005

(51) Int. Cl.
*G03G 5/00* (2006.01)

(52) U.S. Cl. ..... 430/137.19; 430/137.1; 430/137.18; 430/110.1

(58) Field of Classification Search ..... 430/110.1, 430/137.18, 137.19, 137.1
See application file for complete search history.

(56) References Cited

U.S. PATENT DOCUMENTS 6,395,445 B1 * 5/2002 Toth et al. ..... 430/137.14

* cited by examiner

*Primary Examiner*—Mark A. Chapman
(74) *Attorney, Agent, or Firm*—Fay Sharpe LLP

(57) ABSTRACT

The invention relates to color toner compositions prepared from an aqueous pigment concentrate dispersion which renders a toner exhibiting improved pigment dispersion, and consequently improved image density and color characteristics.

10 Claims, 3 Drawing Sheets
(3 of 3 Drawing Sheet(s) Filed in Color)

TONERS WITH IMPROVED PIGMENT DISPERSION

The invention relates to a color toner composition for use in developing an electrostatic image by electrophotographic, electrostatic recording and printing processes.

BACKGROUND

Present day toners are formulated from a range of potential components. Most toner compositions include at least a polymeric binder material and a colorant. Other commonly used components include black and colored magnetic oxides, charge control agents, internal additives to augment toner properties, such as aiding in deagglomeration and homogeneous distribution of the colorant in the toner composition, and external additives, to aid in the proper function of the toner. The components used in a particular toner formulation are dependent on the requirements of the machine in which the toner is ultimately intended to be used. For instance, the toner formulation must take into account such parameters as image quality, reliability, carrier life, toner shelf life, etc., all of which are intricately involved with the mechanical capability and design of the hardware of the machine. Often, there is more than one component of a toner formulation which performs to eradicate certain undesirable properties of the toner. These same components may however, also contribute to other problems, or the combination of two or more components which affect the same toner properties may result in over-correction of a problematic area in the toner performance. Therefore, the combination of components selected to comprise a given toner composition must be carefully balanced, taking into account the full range of toner performance parameters which may be affected by each component and the interaction of each component with every other component of the toner composition, and the machine and its various components and systems.

Given that each of the foregoing parameters will affect toner performance in some manner, it is unlikely that any one toner will achieve optimum performance in all areas. Therefore, toner producers determine which parameters are most critical to the performance of a toner for a given purpose and which may be compromised, and to what extent.

Toner performance is determined by the combination of components, and by the physical, electrical and chemical properties of each. The foregoing properties include particle size, particle size distribution, particle shape, bulk density, mechanical strength, flow properties, triboelectric charge, resistivity, softening point, blocking temperature, melt viscosity, and dispersion. Each of these parameters must be considered for each component in determining what components to combine and how to combine the components to achieve a balanced toner which produces an image having those properties determined to be most important for a specific toner.

One aspect of concern, and the one of most importance to this invention, is that of pigment dispersion. Each toner particle must be consistent with respect to composition and performance, and must exhibit a uniform distribution of colorant, charge control agent, additives, etc. The degree to which this uniform dispersion is achieved affects the resulting triboelectric charge, color, yield, and finally the printed image. The choice of components is further influenced by economic and environmental concerns.

The bulk polymeric material of the toner generally functions as the binder for the colorants included in the toner formulation, but also affects many of the other toner functions, such as charging, electrical resistivity, and mechanical integrity, to name a few. Therefore, often times a combination of resins is used to achieve the desired performance. Polymers used in toner may be linear, branched or cross linked, and are chosen for their various properties and the manner in which these properties are likely to affect toner performance. For example, certain binder polymer properties affect the thermal performance of the toner. These properties include such binder parameters as glass transition temperature, melt viscosity, blocking temperature, and thermal integrity. In the same manner, the mechanical properties of the binder polymer, including such parameters as impact strength, adhesive/cohesive strength, and surface energy will also affect toner performance. Electrical traits such as triboelectric charge function, resistivity, and dielectric constant, and other miscellaneous features, such as moisture resistivity, % volatility, molecular weight, colorlessness, and pigment compatibility, all have an affect on the ultimate performance level of the toner in which the binder is used.

Among the most popular resins from which the toner resin may be selected are: acrylic resins, epoxy resins, polyamide resins, polyester resins, polyethylene resins, polystyrene resins, styrene-acrylic copolymer resins, and styrene-butadiene resins. As with all toner components, choice of resin is generally determined by the machine parameters and toner performance qualities sought.

Dispersed in the binder resin are the colorants used in the toner formulation. In monocomponent toners, magnetic oxide pigments are used for the purpose of enhancing the magnetic attraction between the toner and the developer roll assembly. Carbon black has historically been the most popular colorant used in black toners, as it strongly influences the triboelectric charging capability of the toner. However, more recent toners employ charge control agents to achieve and control this toner feature, thus allowing the use of more easily dispersed black colorants. The black colorant may also affect the flow characteristics of the toner and, therefore, is sometimes added in incremental amounts to the toner surface.

The charge control agents are also critical in full color printing. The equipment of today allows the reproduction of beautiful, photographic-quality full color images. The printer/copier machines generally employ one or more cartridges which dispense color toner, as well as black toner. The basic color toners used are magenta, cyan and yellow, though any number of other color toners are available. Generally, however, variations in color and tone or shade are produced by the combined printed affect of a basic color set of toners.

Most toner formulations also include any one or more of a number of materials known commonly in the industry as additives. These are generally fine particles which are physically blended with the toner at up to about 3% of the composition. They may be attached to the toner by electrical means, mechanical means, or by mere physical mixing, though this is not generally the manner of choice. These additives may be added to influence flow control, charge control, cleaning, fixing, offset prevention, transfer, conductivity control, humidity sensitivity control, and carrier life stability. Common additive materials include silica, metal oxides, metal stearates, fluoropolymer powders, fine polymer powders, rare earth oxides, waxes, conductive particulates, magnetite, carbon, and titanates. Choice of additives is critical, however, given that many of the additives affect more than a single property.

Clearly, given the vast number of components available in the industry for use in toner compositions, and given the propensity for many of the components to enhance some properties and at the same time to deleteriously affect others, choice of components is clearly not a routine matter.

For example, it is known, as was set forth earlier, to produce toner compositions which include pigment colorants. Such compositions may use carbon black. Other color toners may use color pigments commercially available from a number of sources. One means of dispersing a pigment in a toner composition is to use the pigment in the wet cake form. U.S. Pat. Nos. 5,667,929 and 5,591,552 disclose such a process for toner preparation. In these disclosures, pigment in the wetcake form was added to a mixture of linear polyester and toluene to form a pre-dispersion. The water was flushed, or displaced, by a resin/toluene solution, and then the toluene removed to generate a crushed powder of resin and pigment. While this method does increase pigment dispersion to some degree, printed images using the toner nonetheless exhibit very average print quality.

Therefore, it has remained for the current inventor to determine a means by which color or black pigment may be uniformly dispersed in a toner composition. This is accomplished using the pre-dispersion technology set forth hereinafter, which produces a toner suitable for generating a printed image with enhanced brightness of colors, visual density and vividness of color, each of which is directly affected by the quality of the pigment dispersion incorporated into the toner.

SUMMARY OF THE INVENTION

It is therefore an object of the present invention to provide a toner composition which exhibits enhanced performance with respect to visual density, brightness and vividness of color.

It is another object of this invention to provide a toner composition which exhibits a uniform dispersion of pigment components throughout each toner particle.

It is another object of this invention to provide a toner composition which includes a pigment pre-dispersion in a liquid form which is added to dry toner components to produce dry toner with enhanced pigment dispersion.

These and other objects of the invention will become known to the skilled artisan by reading and practicing the invention as described and set forth in the disclosure which follows.

BRIEF DESCRIPTION OF THE DRAWINGS

The file of this patent contains at least one drawing executed in color. Copies of this patent with color drawings will be provided by the Patent and Trademark Office upon request and payment of the necessary fee.

DETAILED DESCRIPTION OF THE INVENTION

Figure 1:
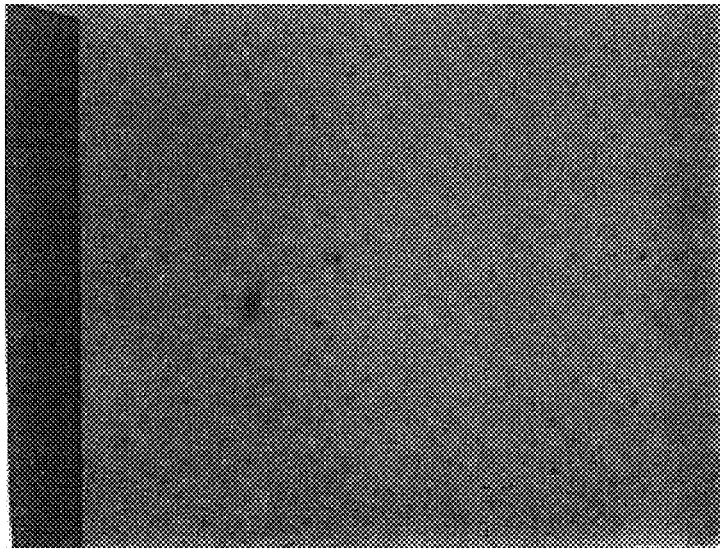
FIG. 1 is a photograph of a hot melt draw-down slide, viewed under optical microscope at 600× magnification, of the toner of the invention.

The present invention is related to a toner for use in the printing and recording of images by electrophotographic and electrostatic processes. More particularly, the invention relates to the use of specific toner components the use of which results in the production of clear, sharp images in bright, vivid color. In various embodiments of the subject invention, there are provided toners and processes for the production and use thereof wherein the toner composition comprises a binder resin, a colorant, and several additives, and wherein the colorant is a water-based pigment pre-dispersion.

The toner composition includes a binder resin which may be selected from any of a number of known resin compound compositions. Suitable resin components include acrylates, epoxies, ethylene vinyl acetates, polyamides, polyolefins, polystyrenes, styrene acrylates, styrene methacrylates, styrene butadienes, cross linked styrene polymers, polyesters, cross linked polyester epoxies, polyurethanes, vinyl resins, including homopolymers or copolymers of two or more vinyl monomers; and polymeric esterification products of a dicarboxylic acid and a diol comprising diphenol. Vinyl monomers include styrene, p-chlorostyrene, unsaturated mono-olefins such as ethylene, propylene, buytlene, isobutylene, and the like; saturated mono-olefins such as vinyl acetate, vinyl propionate and vinyl butyrate and the like; vinyl esters such as esters of monocarboxylic acids, including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate and the like; acrylonitrile, methacrylonitrile, acrylamide, mixtures thereof; and the like. Examples of specific thermoplastic toner resins include styrene butadiene copolymers with a styrene content of from about 70 to about 95 weight percent. Additionally, cross linked resins, including polymers, copolymers, and homopolymers of the aforementioned styrene polymers may be selected.

As one suitable type of toner resin, there are selected the esterification products of a di-or poly-carboxylic acid and a diol comprising a diphenol. These resins are illustrated in U.S. Pat. No. 3,590,000, the disclosure of which is incorporated herein by reference. Other specific example of toner resins include styrene/methacrylate copolymers, and styrene/butadiene copolymers; suspension polymerized styrene butadienes; polyester resins obtained from the reaction of bisphenol A and propylene oxide followed by the reaction of the resulting product with fumaric acid; and branched polyester resins resulting from the reaction of dimethylterphthalate, 1,3-butanediol, 1,2-propanediol, and pentaerythritol, styrene acrylates, and mixtures thereof. Also, waxes with a molecular weight of from about 1,000 to about 7,000, such as polyethylene, polypropylene, paraffin waxes, polyamide waxes and various natural waxes can be included in or on the toner compositions as internal lubricants or fuser roll release agents. Further, reactive extruded polyesters can be selected as the toner resin.

The resin or resins are included in the toner composition disclosed herein in an amount of from about 75% to about 98% of the toner composition. Preferably the resin component is included as from about 90% to about 96% of the total toner composition.

The resin particles have a Tg of from about 50° C. to about 75° C. and an acid number below 30. The weight average molecular weight for the resin component should preferably be between about 10,000 and about 100,000.

As one embodiment of the subject invention, a combination of polyester resin components is used. The combined resin system has a molecular weight between 15,000 and 80,000, wherein the resins employed are both linear polyesters and one is a high molecular weight polyester resin compound exhibiting a molecular weight of about 80,000 and the other is a lower molecular weight polyester resin compound, exhibiting a molecular weight of about 13,000. Exemplary suitable resins for use in combination as described herein include the following commercially available resins and other similar linear polyester compounds: Mitsubishi Rayon FC-900 or FC-611; Reichhold bisphenol-A-fumerate powdered resin designated as Fine Tone 382-ES, and 382ES-HMW; Schenectady Chemicals polyester resins designated as HRJ-11362, HRJ-11364, HRJ-11365, HRJ-11367, HRJ-11439, HRJ-11440 and HRJ11441; and Filco PL 9305.

The colorant used in the toner may be any of the known pigments suitable for use in toner and developer compositions. Specifically, the colorant should be a pigment suitable for use with the recited or suggested resin component, and also compatible with the remaining components of the toner composition. Examples of suitable pigments include organic pigments such as Pigment Red 122; Pigment Red 146; Pigment Blue 15-3; Pigment Yellow 14 and 17; and carbon black, though many known pigments which meet the foregoing parameters may be used. The pigment component should be included in the toner composition in an amount of from about 2% to about 15%, and preferably from about 5% to about 10% by weight of the toner composition.

Particularly well suited to practice of the invention are pigment concentrate dispersions, generally used in liquid inks or paints. Preferably, the pigment concentrate dispersion has an aqueous medium. In addition to the aqueous medium and the dispersed pigment, the dispersion may further include a surfactant, such as a non-ionic surfactant, or a polymeric pigment stabilizer, such as a water soluble acrylic copolymer. Other possible components of the dispersion include compounds such as propylene glycol, which may be included to enhance the viscosity of the pigment dispersion and to aid in pigment wetting.

Charge control agents are added to a toner for the purpose of making the toner product either more electronegative or more electropositive. Whether the toner needs to be made more electronegative or more electropositive is determined by several factors. Some of these include the electronegativity of the remaining toner components as combined, i.e., different colorants and resins may impart different charge characteristics to the toner composition. Also, the carrier, if one will be used, must be considered, as many carrier materials impart a charge to the toner composition. Further, the machine in which the toner is used may impart some charge to the toner, as will the operation thereof. The purpose of the charge control agent component of the toner is to stabilize the toner with respect to electrical charge and thus avoid problems of print quality, color balance, and fogging, which are associated with too much or too little charge on the toner particles. Charge control agents may be selected from quaternary salts, metal and non-metal dyes, chromium, cobalt and zinc complexes, nigrosines, positive and negative colorless polymers, metal chelates, and quaternary amines, depending on the particular requirements of the complete toner composition.

Examples of suitable commercially available charge control agents include the following: S-34, S-40, E-82, E-81, E-84, E-87, E-88 and E-89, all manufactured by Orient Chemicals, and TRH, T-77, T-95, and TNS-2, all manufactured by Hodogaya Chemical Co. Charge control agents offered by BASF, Hoechst/Clariant, Zeneca and others may also be found to be suitable. These and other similar commercially available charge control agents may be selected.

The toner of the present invention further includes external additives employed for the purpose of enhancing flowability of the toner product. The additive used may be a single component additive or may be a specific combination of additives, the combined use of which produces a special performance effect of the toner product. Additives may be selected from silicas, metal stearates, fluoropolymer powders, fine polymer powders, rare earth oxides, waxes, conductive particles, magnetite, carbon, and titanates, and other like compounds.

Post additive treatment agents, such as flowability enhancers of the type used in this toner product, result in deagglomeration of the toner particles in use, and enhanced stability during storage of the toner product. In selecting a flowability enhancing additive to be added to the toner product during a post-treatment step, it is important to consider these parameters: anti-caking; flowability; electrostatic charge; stability; coefficient of friction; transfer efficiency; photoreceptor release properties; hydrophobicity; storage stability; and others. The indication of these characteristics generally requires inorganic compounds of fine particle size and high surface areas. These additives are often treated to render them hydrophobic in order to overcome the drawbacks associated with their conventionally hydrophillic nature.

For example, as the post additive to be employed in production of a toner in keeping with the present invention there may be used a hydrophobic silica fine powder in combination with a hydrophobic titanium oxide powder. Preferably, the titanium oxide powder is a silane treated powder. Other suitable external additives, or post additives, may include but are not limited to the use of aluminum oxide; zinc oxide; cerium oxide; strontium titanate; iron oxide; ferrite powder; calcium carbonate; copper oxide; barium sulfate; lithopone; metal salts of fatty acids; powdered fluoropolymers, such as Kynar; polytetrafluoroethylene; polyethylene powder; carbon black; silicon carbide; silicon nitride; and powdered or fine particle polymers.

As an example of a toner formulation in accord with the claimed invention, provided hereinafter is processing information and toner formulations representative of one embodiment of the toner compositions.

For each of the following toner compositions, aqueous pigment concentrate dispersions commercially available from Sun Chemical were used. The dispersions are generally intended for use in liquid ink compositions and paints. Each dispersion included an aqueous base into which had been dispersed the desired pigment and a small amount of acrylic polymer, which functions as a pigment stabilizer. No surfactants are included in the dispersions used in the following examples, though other dispersions including surfactants would be expected to generate similar results. Each dispersion exhibited pigment concentration of about 30 wt % solids to about 40 wt % solids.

For each toner composition according to this invention, the aqueous pigment concentrate dispersion of the appropriate color was added to a Henschel High Intensity Mixer along with the remaining toner components, in the amounts set forth in Table I. The components were blended for ten (10) minutes at a speed of 2000 RPM.

The resulting blend of resin, wax, charge control agent, pigment, and about 12 wt % water, from the aqueous pigment concentrate dispersion, was then transferred to a Warner & Pfleiderer ZSK-30 twin screw extruder for compounding at 150° C., at 400 RPM and about 64% torque.

The foregoing produced a ribbon of molten toner in each color, i.e., cyan, magenta and yellow. The molten toner was cooled, coarse crushed, and then jet pulverized in a Fluid Energy Jet Mill using compressed air to produce a fine powder of optimum uniform particle size and distribution.

The mean particle size by volume of a toner in keeping with this processing may range from 5 to 15 microns, as measured on a Coulter Multisizer, depending upon the application and the requirements of the imaging machine in which the toner will be used. The toner produced in this specific embodiment had an average particle size of about 7.5 microns. Preferably, the Fluid Energy Mill is operated to control not only the mean particle size but also the top side size or largest particles present at about 17 microns. This is accomplished by controlling the air flow and the Classifier Wheel speed of the integral coarse classifier. The resulting fine powder toner was passed through an Air Classifier to selectively remove the ultra-fine particles, usually those of 5 microns or smaller, which may be detrimental to the xerographic process.

The toner powder thus produced was then post treated by blending the powder, in a Henschel High Intensity Blender, with a combination of post additives, in this instance hydrophobic silane treated silica fine powder and hydrophobic silane treated titanium oxide powder. Of course, a single post additive agent may also be used. The skilled artisan will be able to determine what post additive or post additive combination will best suit the intended toner product. Treatment with the post additives produced a toner powder with optimum flow properties for use in the intended printer/copier machine.

The use of the aqueous pigment concentrate dispersion is critical to the toner prepared in accord with the subject invention for sufficient deagglomeration and predispersion of the colorants in the toner powder.

EXAMPLE 1

In this Example 1, a cyan color toner was prepared in accord with the foregoing process parameters. The aqueous pigment concentrate dispersion used was BFD-1121 Pigment Blue, available commercially from Sun Chemical. The pigment dispersion was in liquid form and contained 30.8% pigment, 60% water and 9.2% acrylic polymer pigment stabilizer. The toner contained 9.5% by weight of this dispersion. The binder resin used in this toner was a styrene butyl acrylate copolymer resin, and was added in an amount of 79% by weight of the composition. Additional dry pigment concentrate was also added. Keystone Blue GN pigment, available commercially from Keystone Aniline Corp., was added as 4.5 wt % of the formulation. The charge control agent, used as 2.0 wt % of the composition, comprised Bontrol E-84, available commercially from Orient Chemicals. In addition to the foregoing, the composition included 4 wt % of Ceralub P-40 polypropylene wax, available commercially from Shamrock Technologies, Inc., and 1 wt % Cabosil M-5 silica fine powder, available commercially from Cabot Corporation. The foregoing was blended, extruded, cooled and crushed in accord with the processing parameters previously established to produce a toner exhibiting a mean particle size of 7.5 microns. Once the toner powder was classified, 98.3 wt % based on total weight of the final toner powder was added to 1.7 wt % of a combination of post-additive agents which were used to enhance flow control. The agents used comprised a hydrophobic silane treated silica fine powder at 1.0 wt % and a hydrophobic titanium dioxide fine powder at 0.7 wt %.

This toner exhibited enhanced image density, brightness and vividness of colors. Also, upon examination as a hot melt draw-down on a glass slide under an optical microscope at 600× magnification, the toner showed very good pigment dispersion, with few or no agglomerates and few or no void areas lacking pigment.

EXAMPLE 2

The yellow toner of this example was prepared in accord with the toner described above as Example 1, except that 11.5% of a yellow aqueous pigment concentrate dispersion, YFD-4249 Pigment Yellow 17 dispersion, available commercially from Sun Chemical, was used in place of the cyan pigment dispersion of that example. This yellow pigment dispersion contained pigment, water and acrylic polymer pigment stabilizer. Also, dry pigment concentrate Clarient Permanent Yellow GG Pigment Yellow 17 was used in place of the Keystone Blue Pigment of Example 1. The remaining toner components were the same, but were used in the amounts shown in Table I, in wt % based on the total weight of toner components prior to post-additive blending. The same post-additive regimen was used as in Example 1.

This toner also produced images exhibiting enhanced density and brightness and vividness of color. In addition, a hot melt draw-down on a glass slide, viewed under optical microscope at 600× magnification, revealed excellent pigment dispersion with little or no agglomeration and few or no void areas lacking pigment.

EXAMPLE 3

In Example 3, a magenta toner was prepared in accord with the toner preparation of Example 1, but differed in that the following were used: 21 wt % of liquid magenta aqueous pigment concentrate dispersion, comprising pigment, water and acrylic polymer pigment stabilizer; and 4.0 wt % of dry pigment concentrate, Clarient HostaCopy M-501 Pigment Red 122. Additionally, this toner did not include Cabosil M-5 Silica. All other components were in keeping with Example 1, in the amounts shown in Table 1, including the post-additive treatment. This toner gave results consistent with those set forth with respect to the toners of Examples 1 and 2.

FIG. 1 is a photograph of the hot melt draw-down slide prepared for this magenta toner, viewed under optical microscope at 600× magnification. Very few, if any, agglomerates are visible, and no void areas lacking pigment are observed.

COMPARATIVE EXAMPLE 4

The toner of this Example 4 was prepared in accord with the toner preparation set forth in Example 1, but contained dry pigment concentrate, as opposed to the aqueous pigment concentrate dispersion used in Example 1, consisting of 40 wt % Pigment Blue 15.3 and 60 wt % styrene butylacrylate copolymer resin. This pigment concentrate, at 12.5 wt %, was combined with Keystone Blue GN Pigment at 4.0 wt %. The remaining components were in keeping with Example 1, although the amounts were of necessity different, as is seen in Table 1.

The toner did not produce images as bright and vivid as those produced with the toners of Examples 1, 2 and 3. In addition, examination of a hot melt draw-down on a glass slide under an optical microscope at 600× magnification revealed poor pigment dispersion with agglomerates several microns in size and numerous void areas lacking any visible pigmentation.

COMPARATIVE EXAMPLE 5

The yellow toner composition of this Example 5 was prepared in accord with the toner processing set forth in Example 1, except that no aqueous pigment dispersion was used. Instead, dry pigment concentrate, consisting of 40 wt % Pigment Yellow 17 and 60 wt % styrene butylacrylate copolymer resin, at 12.5 wt %, and Solvent Yellow 162 dye were used. The remaining components of this toner were consistent with those of Example 1, at the wt % shown in Table I.

This toner produced images with poor image quality as compared to that of Examples 1, 2 and 3, and upon microscopic examination consistent with that used in the prior examples exhibited poor pigment dispersion, with pigment agglomerations of several microns in size and void areas lacking any pigmentation.

COMPARATIVE EXAMPLE 6

The magenta toner of this Example 6 was prepared in accord with the toner preparation set forth in Example 1. This toner, however, did not contain an aqueous pigment concentrate dispersion, but rather included dry pigment concentrate, consisting of 40 wt % Pigment Red 122 and 60 wt % styrene butylacrylate copolymer resin, included at 22 wt %, and Grand Red D-041 dye at 1 wt %. The remaining components were consistent with that shown in Example 1, but at the wt % shown in Table I, except no Cabosil M-5 Silica was used in this toner.

Figure 2:
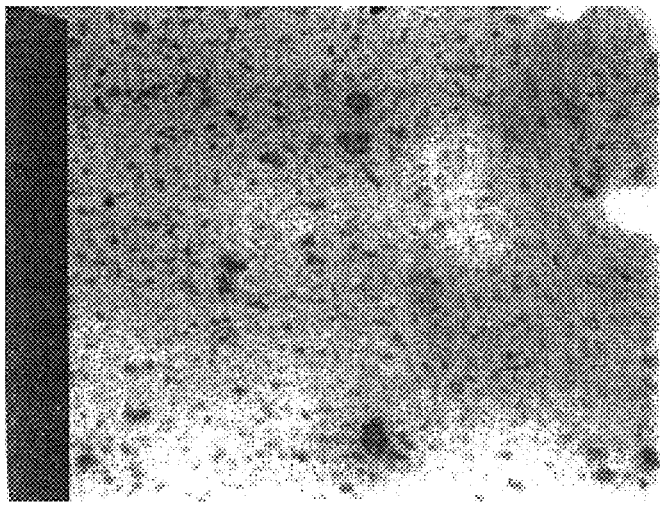
FIG. 2 is a photograph of a hot melt draw-down slide, viewed under optical microscope at 600× magnification, of a conventional dry melt toner prepared by the inventor.

The toner of this example did not produce images having the density, brightness and vividness of color shown in images printed from the toners of Examples 1, 2 and 3. Further, optical microscope examination of the toner particles in accord with the foregoing examples, as shown in FIG. 2, showed poor pigment dispersion, and unacceptable pigment agglomeration and void areas lacking any pigment. A comparison of this photograph to that of FIG. 1 clearly demonstrates the improved dispersion achieved using the subject process and toner composition.

COMPARATIVE EXAMPLES 7–9

Figure 3:
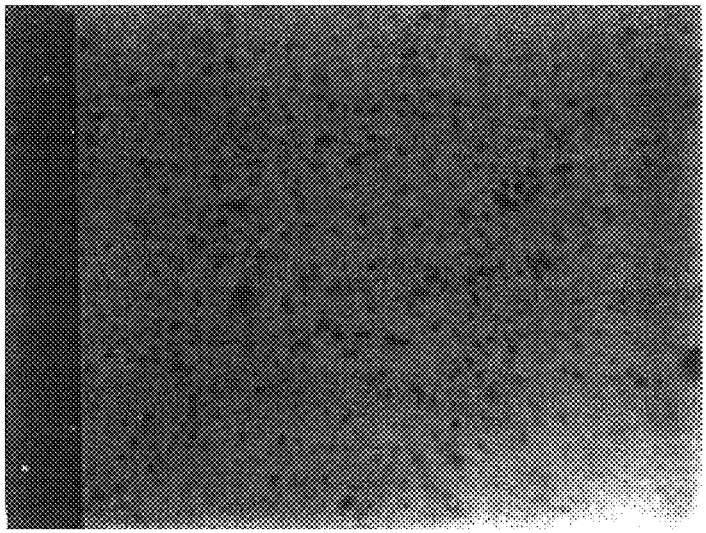
FIG. 3 is a photograph of a hot melt draw-down slide, viewed under optical microscope at 600× magnification, of a commercially purchased toner.

The toners evaluated as the basis of these Examples 7, 8, and 9 were commercially available toners in cyan, yellow and magenta, intended for use in the HP 4500 print engine. The toners were not prepared or formulated by the inventors, but were subjected to microscopic evaluation. Draw-down slides were prepared from the commercial toners of each of Examples 7, 8, and 9 in accord with the methodology used to evaluate the toners of Examples 1–6, and the slide was then examined at 600× magnification. The slides showed toner particles with poor pigment dispersion, much the same as that found in Examples 4, 5 and 6, though not as poor. FIG. 3 is a photograph of the commercially purchased magenta toner labeled Example 9. As can be seen, this toner exhibited many particle agglomerates, seen in the photograph as black spots on the magenta field. While the void areas are not as considerable as that seen in FIG. 2, the color was not as uniform as that shown in FIG. 1, which was made using the inventive toner disclosed herein.

TABLE 1

| | EXAMPLES | | | | | | | | |
|---|---|---|---|---|---|---|---|---|---|
| | 1 | 2 | 3 | 4 | 5 | 6 | 7* | 8* | 9* |
| COMPONENTS | | | | | | | | | |
| BFD-1121 Pigment Blue Dispersion | 9.5 wt % | | | | | | Cyan | Yellow | Magenta |
| YFD-4244 Pigment Yellow 17 Dispersion | | 11.5 wt % | | | | | | | |
| QFD-1146 Pigment Red 122 Dispersion | | | 21 wt % | | | | | | |
| Pigment Blue 15.3 | | | | 12.5 wt % | | | | | |
| Pigment Yellow 17 | | | | | 12.5 wt % | | | | |
| Pigment Red 122 | | | | | | 22 wt % | | | |
| Keystone Blue GN Pigment | 4.5 wt % | | | 4.0 wt % | | | | | |
| Clarient Permanent Yellow GG Pigment Yellow 17 | | 4.5 wt % | | | | | | | |
| Clarient Hostacopy M-501 Pigment Red 122 | | | 4.0 wt % | | | | | | |
| Neopen Yellow 075/ Solvent Yellow 162 Dye | | | | | 3.0 wt % | | | | |
| Grand Red D-041 Dye | | | | | | 1.0 wt % | | | |
| Styrene Butyl Acrylate Co-polymer Resin | 79 wt % | 77 wt % | 69 wt % | 77.5 wt % | 77.5 wt % | 70 wt % | | | |
| Ceralub P-40 Polypropylene Wax | 4 wt % | 4 wt % | 4 wt % | 4 wt % | 4 wt % | 4 wt % | | | |
| Zinc Salicylic Acid Complex CCA | 2 wt % | 2 wt % | 2 wt % | 2 wt % | 2 wt % | 2 wt % | | | |
| Silica Fine Powder | 1 wt % | 1 wt % | | 1 wt % | 1 wt % | | | | |
| Hydrophobic Silica Post Additive | 1.0 wt % | 1.0 wt % | 1.0 wt % | 1.0 wt % | 1.0 wt % | 1.0 wt % | | | |
| Strontium Titanate Post Additive | 0.7 wt % | 0.7 wt % | 0.7 wt % | 0.7 wt % | 0.7 wt % | 0.7 wt % | | | |

TABLE 1-continued

| | EXAMPLES | | | | | | | | |
|---|---|---|---|---|---|---|---|---|---|
| | 1 | 2 | 3 | 4 | 5 | 6 | 7* | 8* | 9* |
| TONER PERFORMANCE | | | | | | | | | |
| Image; Color | Excellent | Excellent | Excellent | Fair | Fair | Fair | Good | Good | Good |
| Presence of Agglomerates | None | None | None | Large | Large | Large | Some | Some | Some |
| Presence of Voids | None | None | None | Many | Many | Many | Some | Some | Some |

*HP4500 Commercially Purchased Toner-formulation unknown

Clearly the color toners of Examples 1, 2 and 3, prepared using a liquid aqueous pigment concentrate dispersion, performed in a superior manner. For example, the use of a dry pigment concentrate alone, as demonstrated in Examples 4, 5 and 6, did not result in a toner composition that generated acceptable print quality with respect to image density, brightness and vividness of color reproduction. Additionally, upon microscopic evaluation these same toners exhibited poor pigment dispersion and the presence of pigment agglomerates and void areas lacking any pigment. Examples 7, 8, and 9 showed evaluation results improved over Examples 4, 5, and 6, but not to the level of Examples 1, 2, and 3, which were prepared according to the invention.

The invention contemplated by this disclosure includes color toner formulations prepared using an aqueous, liquid state, pigment concentrate dispersion containing about 40% solids. The invention is shown to be well suited to the preparation of a full color set of toners, including magenta, cyan and yellow toners. It is to be understood that the inventive aspects of the formulation as presented herein are equally applicable to all color toner formulations, and it is intended that the invention should be construed in keeping with and afforded the full breadth of coverage of the appended claims.

Having thus described the invention, I claim:

1. A process for preparing a toner composition comprising:

a) blending an aqueous, liquid state, pigment concentrate dispersion with dry toner components including a binder resin, a charge control agent and a release agent, wherein the aqueous pigment concentrate contributes about 10 wt % to about 15 wt % water to the blend;

b) compounding the blend from step (a) to produce a ribbon of molten toner;

c) cooling and coarse crushing the toner ribbon;

d) jet pulverizing the crushed toner to produce a toner powder with a mean particle size by volume of from about 5 μm to about 15 μm; and e) optionally blending the toner powder with one or more post additive agents, wherein the toner particles exhibit under microscopic examination at 600× magnification substantial uniformity of component content and are substantially free of pigment particle agglomerates and voids having no pigment.

2. The process of claim 1 wherein the aqueous pigment concentrate dispersion contains about 30 wt % pigment solids to about 40 wt. % pigment solids.

3. The process of claim 1 wherein a dry colorant component is included in step (a).

4. The process of claim 1 wherein the aqueous pigment concentrate dispersion comprises an aqueous medium, a dispersed pigment, and at least one of a surfactant, a polymeric pigment stabilizer, a viscosity enhancing agent and welling agent.

5. The process of claim 4 wherein the aqueous pigment concentrate dispersion comprises an aqueous medium, dispersed pigment and polymeric pigment stabilizer.

6. The process of claim 4 wherein the aqueous pigment concentrate dispersion comprises an aqueous medium, dispersed pigment and a surfactant.

7. An electrophotographic toner composition comprising homogeneous particles of toner, each particle possessing a uniform mixture of resin, colorant and additives, wherein the colorant is a pigment provided in the form of an aqueous pigment concentrate dispersion in the liquid state, having a pigment concentration of from about 40 wt % solids to about 40 wt % solids, and the remaining toner components are orovided in dry form.

8. The electrophotographic toner composition of claim 7 wherein the aqueous pigment concentrate dispersion comprises an aqueous medium, a dispersed pigment, and at least one of a surfactant, a polymeric pigment stabilizer, a viscosity enhancing agent and welling agent.

9. The electrophotographic toner composition of claim 8 wherein the aqueous pigment concentrate dispersion comprises an aqueous medium, dispersed pigment and polymeric pigment stabilizer.

10. The electrophotographic toner composition of claim 8 wherein the aqueous pigment concentrate dispersion comprises an aqueous medium, dispersed pigment and a surlactant.

* * * * *